US005758388A

United States Patent [19]

Bjerke

[11] Patent Number: 5,758,388

[45] Date of Patent: Jun. 2, 1998

[54] DEVICE FOR USE ON SKI POLE HANDLES

[75] Inventor: Harald Bjerke, Vingrom, Norway

[73] Assignee: Swix Sport AS, Aretta, Norway

[21] Appl. No.: 753,246

[22] Filed: Nov. 25, 1996

[30] Foreign Application Priority Data

Nov. 27, 1995 [NO] Norway ..... 954798

[51] Int. Cl.[6] ..... A47B 95/02

[52] U.S. Cl. ..... 16/114 R; 280/821

[58] Field of Search ..... 16/114 R, 110 R, 16/111 R, DIG. 12; 280/819, 822, 823, 821; 294/98, 59

[56] References Cited

U.S. PATENT DOCUMENTS 4,288,102 9/1981 Ramer ..... 280/821

4,493,494 1/1985 Feagin ..... 280/821

4,641,857 2/1987 Gailiunas ..... 280/821

4,645,235 2/1987 Joseph ..... 280/821

5,470,108 11/1995 Goode et al. ..... 280/823

*Primary Examiner*—Chuck Mah

*Attorney, Agent, or Firm*—Sterne, Kessler, Goldstein & Fox P.L.L.C.

[57] ABSTRACT

Device for use on ski pole handles, as an aid for keeping the handle against or in close vicinity to the user's hand, comprising an element adapted to be fastened by insertion of an attachment member on the element in a strap aperture in the handle, whereby a portion of the element protrudes from the handle.

5 Claims, 1 Drawing Sheet

DEVICE FOR USE ON SKI POLE HANDLES

BACKGROUND OF THE INVENTION

1. Field of the Invention

The present invention relates to a device for use on ski pole handles.

2. Related Art

A well known problem within ski sport, and in particular within competition sport, is that a skier who during motion loses the grip around a pole handle usually will have a problem in reestablishing the grip, because the pole will be hanging in the wrist strap in such a manner that the handle is situated lower than the hand. This is of little importance to a noncompeting skier, but it may be of great importance during competitions.

Handles which solve the problem and having a special design have been proposed , whereby the handles comprise elements which more or less prevent the pole from falling down when the grip around the handle ceases. For instance DE Patent 2506221 shows a pole handle equipped with an upper plate which during use is situated above the user's hand. The handle has a special design adapted for the mounting of the plate, and the plate cannot be mounted on other types of handles. EP Patent 0081439 shows i.a. a handle having an upper thickening. The latter will, in cooperation with a wrist strap, only to a small degree prevent the pole from falling down when the grip around the handle ceases. This takes place only when the strap is very tight. DE Patent 2510608 shows a pole handle having a hoop in front of the grip portion of the handle, whereby the user's fingers, except for the thumb, are kept inserted through the hoop during use of the pole.

A condition for all these known solutions is that the pole is equipped with a specially designed handle.

SUMMARY OF THE INVENTION

The present invention provides a device which permits mounting on most of the known types of ski pole handles.

The device according to the invention is for use on ski pole handles, as an aid for keeping the handle against or in close vicinity to the user's hand, and the device comprises an element adapted to be fastened by insertion of an attachment member on the element in a strap aperture in the handle, whereby a portion of the element protrudes from the handle.

The device according to the invention is a separate element which can be mounted on a pole handle by use of an aperture for the wrist strap. The element has an attachment member which can be inserted in the strap aperture. In the inserted position the attachment member can be locked in any manner. An appropriate manner is to use a screw or pin. Some pole handles, in particular for alpine skiing, are of such a structure that the handle has a screw in its uppermost portion for fastening of the strap, which has a hole for the screw. Other pole handles have an upper locking member comprising at least one pin, and the locking member and the pin can be forced down in the handle, whereby the pin is guided through a hole in the handle and the strap, analogous with screwing down a screw. The strap may be doublefolded when inserted in the aperture in the handle, and the strap may have two holes near the fold, whereby the holes are in registry with each other after the folding. When the aperture in the handle in which the strap and the element according to the invention are to be inserted is not occupied farthest in, the innermost end of the attachment member may have a thickening, which will be situated inside the end of the strap and be locked thereby.

The protruding portion of the element may be mainly planar or slightly curved, and it may protrude approximately in a right angle to the main direction of the handle or slightly sloping relatively to this direction. The circumferential shape of the protruding portion of the element may be varied within wide limits. An appropriate shape is approximately oval or rectangular with rounded corners. The protruding portion may have an approximately even thickness, but it may also have longitudinal ribs for reinforcement, in particular on its upper side.

The dimensions of the attachment member must be adapted to the dimensions of the strap aperture, while the dimensions and shape of the protruding portion can vary within a large range. A suitable length dimension of the protruding member is between 3 and 6 cm, but these limits do not constitute any limitation. The maximum width of the protruding member may also vary within a large range.

Thus, a device has been provided which can be mounted on many types of pole handles. The only condition is that the strap aperture gives room for the attachment member in addition to the strap itself. The attachment member may be rather thin, having for instance a thickness of approximately 1 mm or less. A particularly small thickness can be used when the attachment member is metallic, for instance a steel plate, which may be moulded into or fastened to the remainder of the element in another manner. The remainder of the element may conveniently be of plastics or rubber. If the aperture does not give room for the attachment member in addition to the strap, the strap may be replaced by a thinner strap.

The attachment member is inserted in the strap aperture above the strap, whereby, when a hand is inserted in the strap from below, the protruding portion of the element will be situated above the hand against the edge of the hand palm, near the thumb. The protruding portion is presupposed to have such a stiffness that it can keep the pole elevated and maintain the pole handle in a grip position relatively to the hand in cooperation with the wrist strap.

Thus, the device will prevent the pole from falling down even if the grip around the handle ceases, presupposed that the strap is normally tightened.

The device according to the invention will in the following be explained more detailed with reference to the accompanying drawing.

DETAILED DESCRIPTION OF THE PREFERRED EMBODIMENTS

Figure 1:
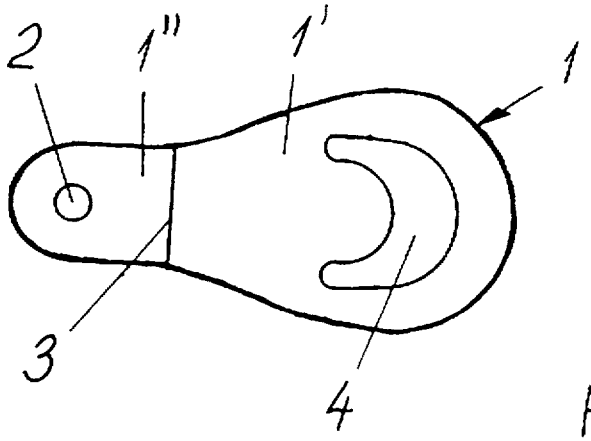
FIG. 1 shows an element in accordance with the invention.

The element 1 shown in FIG. 1 may be made in one piece, for instance of plastics or rubber, and for instance by casting. The element may also be punched out of a sheet material, whereby the element will have an even thickness. The shown element 1 comprises a portion 1' constituting the active part of the element and an attachment member 1" for fastening the element 1 to a pole handle. The portion 1' is shown having a recess 4, but this has no technical function and may be omitted. The recess 4 makes the portion 1' more resilient than an element without a recess. Between the portion 1' and the attachment member 1 " is a partition line 3, which may be a step between portions of different thicknesses.

Figure 2:
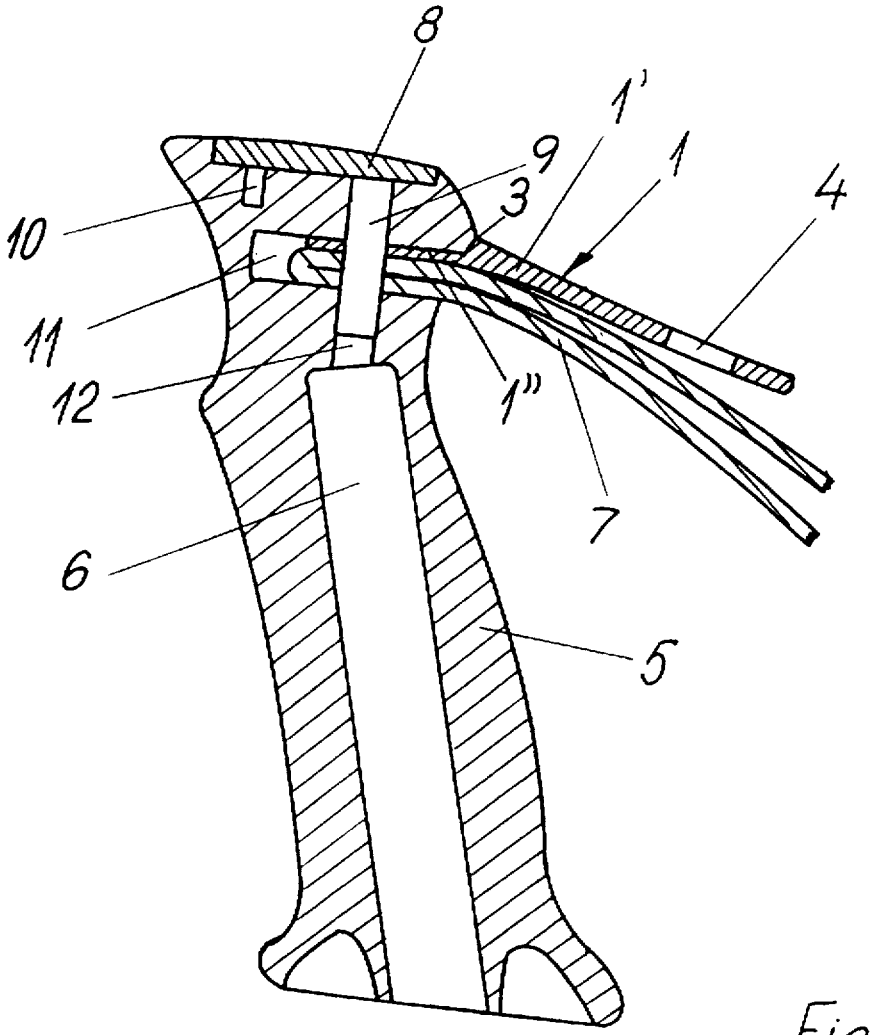
FIG. 2 shows in a longitudinal section a ski pole handle having an element in accordance with the invention mounted in a wrist strap aperture in the handle.

FIG. 2 shows a ski pole handle 5, which in the shown embodiment is an alpine handle. The handle has in a known manner a bore 6 for being mounted on a pole, and a strap 7 is fastened to the handle. The attachment means for the strap 7 is of a known type, and comprises an upper plate 8 from which two pins 9 and 10 depend. The strap 7, being doublefolded at the insertion end, has been inserted in an aperture 11 in the handle 5. In the same aperture 11 an element 1 in accordance with the invention has been mounted, whereby the attachment member 1" is situated in the aperture 11, while the portion 1' protrudes from the handle 1, rearwardly relatively to the direction of movement and above the strap 7. The strap 7 has holes which in the inserted position of the strap are in registry with the hole 2 (FIG. 1) in the element 1, and the pin 9 on the plate 8 has been inserted through all the holes, in a bore 12 in the handle 5. The strap 7, possibly also the attachment member 1", may have a reinforcement around the hole, for instance an eye (not shown). The step 3 is situated immediately outside the mouth of the strap aperture 11 of the handle 5.

The pin 10 is merely an auxiliary part and may have a thickening, for instance a circumferential bead (not shown), in order to secure fastening of the plate 8 to the remainder of the handle, in that the thickening exerts a pressure against the corresponding hole in the handle 5.

The strap 7, of which is only shown the portion nearest to the handle 5, forms a loop, and may in a known manner be equipped with a buckle for adjustment of the effective strap length.

In the shown embodiment the thickness of the attachment member 1" comprises approximately 20% of the thickness of the doublefolded strap 7. If the aperture 11 does not give room for an attachment member having such a thickness, the attachment can be made even thinner. In order to achieve a sufficient strength the attachment member may be made as a thin steel plate, which may be moulded into the portion 1'. Thereby, the attachment member may be given a thickness which comprises less than 10% of the strap thickness.

The protruding portion 1' is in FIG. 1 shown as being symmetrical about a longitudinal axis, but the portion 1' may also be asymmetrical about the longitudinal axis. In order to achieve a suitable bending stiffness with a small consumption of material the portion 1' may have longitudinal ribs on the upper side. Such ribs will not interfere with the hand during use.

In the shown embodiment of the handle 5 the attachment member 1" may also be formed with a thickening on the innermost end, i.e. the free end, whereby the thickening will be situated inside the folded strap end in the aperture 11. Thereby, the strap 7 will constitute a retainer for the element 1, whereby fastening of the element 1 is not exclusively, or not at all, based on the hole 2 and the pin 9.

The element 1 can also be mounted on a handle which does not have any plate with a pin at its top. In some handles a screw is used for fastening the strap, and such a screw can be used for fastening an element in accordance with the invention. By post-mounting of such an element on a pole handle not previously equipped with such an element the screw is screwed out, the element is inserted in the aperture, and the screw is re-screwed into the hole. Also in this case the attachment member may have a thickening to be placed inside the strap end, provided that the strap aperture gives room for such a thickening. In handles which do not comprise a plate with a pin, nor a screw and a screw hole, a screw hole can be drilled and a screw can be screwed through the hole in the attachment member after inserting the latter in the strap aperture.

The invention is not limited for use on alpine poles but can be used on all types of ski poles. Plastics, possibly combined with metal for the attachment member, is not a limitation with respect to materials. For instance rubber is well suited, in particular for the protruding portion 1'.

I claim:

1. Device for use on a ski pole handle as an aid for keeping said handle against or in close vicinity to a user's hand, said device comprising:

a ski pole handle having a strap receiving aperture formed therein;

a strap at least partially disposed within said strap receiving aperture; and an element having an attachment member and a protruding portion, wherein said attachment member is at least partially disposed within said strap receiving aperture of said handle and said protruding portion protrudes from said handle.

2. Device as claimed in claim 1, wherein said element is formed of a plastic material, and said attachment member has a smaller thickness than said protruding portion of said element.

3. Device as claimed in claim 1, wherein said protruding portion of said element is formed of a plastic material and said attachment member is formed of a metallic material and is molded into said protruding portion.

4. Device as claimed in claim 1, wherein said attachment member has a hole for a pin or a screw.

5. Device as claimed in claim 1, wherein said attachment member has a thickening at its free (inner) end.

* * * * *